US010542786B2

(12) United States Patent
Wonsey

(10) Patent No.: US 10,542,786 B2
(45) Date of Patent: Jan. 28, 2020

(54) HEAD WRAP

(71) Applicant: Patricia Linda Wonsey, Orlando, FL (US)

(72) Inventor: Patricia Linda Wonsey, Orlando, FL (US)

( * ) Notice: Subject to any disclaimer, the term of this patent is extended or adjusted under 35 U.S.C. 154(b) by 68 days.

(21) Appl. No.: 15/984,606

(22) Filed: May 21, 2018

(65) Prior Publication Data

US 2018/0332917 A1 Nov. 22, 2018

Related U.S. Application Data

(63) Continuation-in-part of application No. 29/605,375, filed on May 25, 2017, now Pat. No. Des. 830,041.

(60) Provisional application No. 62/508,490, filed on May 19, 2017.

(51) Int. Cl.

| | |
|---|---|
| ***A42B 1/04*** | (2006.01) |
| ***A42B 3/28*** | (2006.01) |
| ***A42B 1/24*** | (2006.01) |
| ***A42B 1/00*** | (2006.01) |
| ***A41D 20/00*** | (2006.01) |
| ***A42B 1/22*** | (2006.01) |
| ***A42B 7/00*** | (2006.01) |
| ***A42C 5/04*** | (2006.01) |

(52) U.S. Cl.

CPC ..... *A42B 1/004* (2013.01); *A41D 20/005* (2013.01); *A42B 1/041* (2013.01); *A42B 1/22* (2013.01); *A42B 1/24* (2013.01); *A42B 3/28* (2013.01); *A42B 7/00* (2013.01); *A42C 5/04* (2013.01)

(58) Field of Classification Search

CPC ..... A42B 1/046; A42B 1/22; A42B 1/004; A42B 1/06; A41D 23/00; A41D 2023/004

USPC ..... 2/171, 174, 204, 207

See application file for complete search history.

(56) References Cited

U.S. PATENT DOCUMENTS

| | | | | | |
|---|---|---|---|---|---|
| 2,431,568 | A | * | 11/1947 | Kovitz | A41D 23/00 2/204 |
| 3,360,802 | A | * | 1/1968 | Kasamatsu | A41D 23/00 2/207 |
| D596,382 | S | * | 7/2009 | Dolby | D2/877 |
| D735,446 | S | * | 8/2015 | Daws | D2/823 |
| D756,073 | S | * | 5/2016 | Mahoney | D2/877 |
| D787,690 | S | * | 5/2017 | Mackay | D24/189 |
| D830,041 | S | * | 10/2018 | Wonsey | D2/877 |

(Continued)

*Primary Examiner* — Gloria M Hale

(57) ABSTRACT

A head wrap is an apparatus that is used to protect and decorate a user's head. The apparatus includes a head-bracing body, an elastic strip, a first lateral tail, a second lateral tail, a first intermediate tail, a second intermediate tail, a plurality of ornaments, and a ventilation mechanism. The head-bracing body is the primary coverage means for the back of the user's head. The elastic strip connects to the head-bracing body to allow the head-bracing body to expand in order to fit different head sizes. The first lateral tail, second lateral tail, first intermediate tail, and second intermediate tail each connect to the head-bracing body, allowing for coverage of the user's head. The at least one ornament relates to a decorative unit or several units capable of being tied to the first lateral tail, second lateral tail, first intermediate tail, and second intermediate tail as a means of displaying the decorative pattern. The plurality of ventilation holes allows for heat trapped between the present invention and the user's head to escape.

20 Claims, 6 Drawing Sheets

(56) References Cited

U.S. PATENT DOCUMENTS

| | | | | |
|---|---|---|---|---|
| D830,341 | S * | 10/2018 | Yokozeki | D14/210 |
| 2015/0052661 | A1* | 2/2015 | Poznick | A42B 1/048 2/202 |
| 2016/0316836 | A1* | 11/2016 | Kelley | A41D 27/08 |

* cited by examiner

HEAD WRAP

The current application claims a priority to the U.S. Provisional Patent application Ser. No. 62/508,490 filed on May 19, 2017 and a priority to the U.S. Design patent application Ser. No. 29/605,375 filed on May 25, 2017. The current application is filed on May 21, 2018 while May 19, 2018 was on a weekend.

FIELD OF THE INVENTION

The present invention relates generally to a garment. More specifically, the present invention is a stylish addition to a user's wardrobe that enables protection and covering of the user's head. A set of extensions enables a user to tie the present invention securely in front of the user's head.

BACKGROUND OF THE INVENTION

A variety of garments are commonly utilized to protect a user's head. Hats, fabric covers, visors, bandanas, and similar devices create separation between the user's head and potentially harmful environmental stimuli, such as rainy weather or intense heat. Particularly in the case of intense heat, various head wraps are commonly utilized. These devices wrap around the user's head and generally tie to secure to the user. Such devices have the further benefit of enabling the user to tie a variety of patterns into the connecting end. Many of these devices further have pretied patterns and bows that are attached to the head wrap, adding a stylistic flair to the head wrap.

However, such devices are often difficult to use or manage. Too often, the bow designs are stitched directly onto the wrap body, throwing off the balance of the head wrap during use. These head wraps are also not modular, and thus the designs may grow stale or boring. Other versions have only two securing straps. This arrangement makes it more difficult for the user to secure the head wrap around the user's head, as the wrap may tend to slide up or down over the user's head. Such wraps are also often made of flexible, but non-elastic material, restricting their ability to conform to the user's head, or various head sizes. What is needed is a head wrap with multiple tails, enabling secure attachment of the present invention to the user's head. What is further desirable is a head wrap with an elastic portion that enables comfortable addition to various head sizes, and a mesh back to prevent the head from overheating.

The present invention addresses these issues. The present invention has a flexible body that conforms to the user's head. Several tails extending from the back portion enable a variety of tying means and patterns, as well as secure addition of a variety of pre-designed bows. An elastic strip at the back of the present invention enables the tails to extend as needed around the user's head, and generally allows the present invention to stretch to fit different head sizes. A mesh segment in the back of the present invention provides ventilation, thus preventing the user's head from overheating during use.

DETAILED DESCRIPTION OF THE INVENTION

All illustrations of the drawings are for the purpose of describing selected versions of the present invention and are not intended to limit the scope of the present invention.

Figure 1:
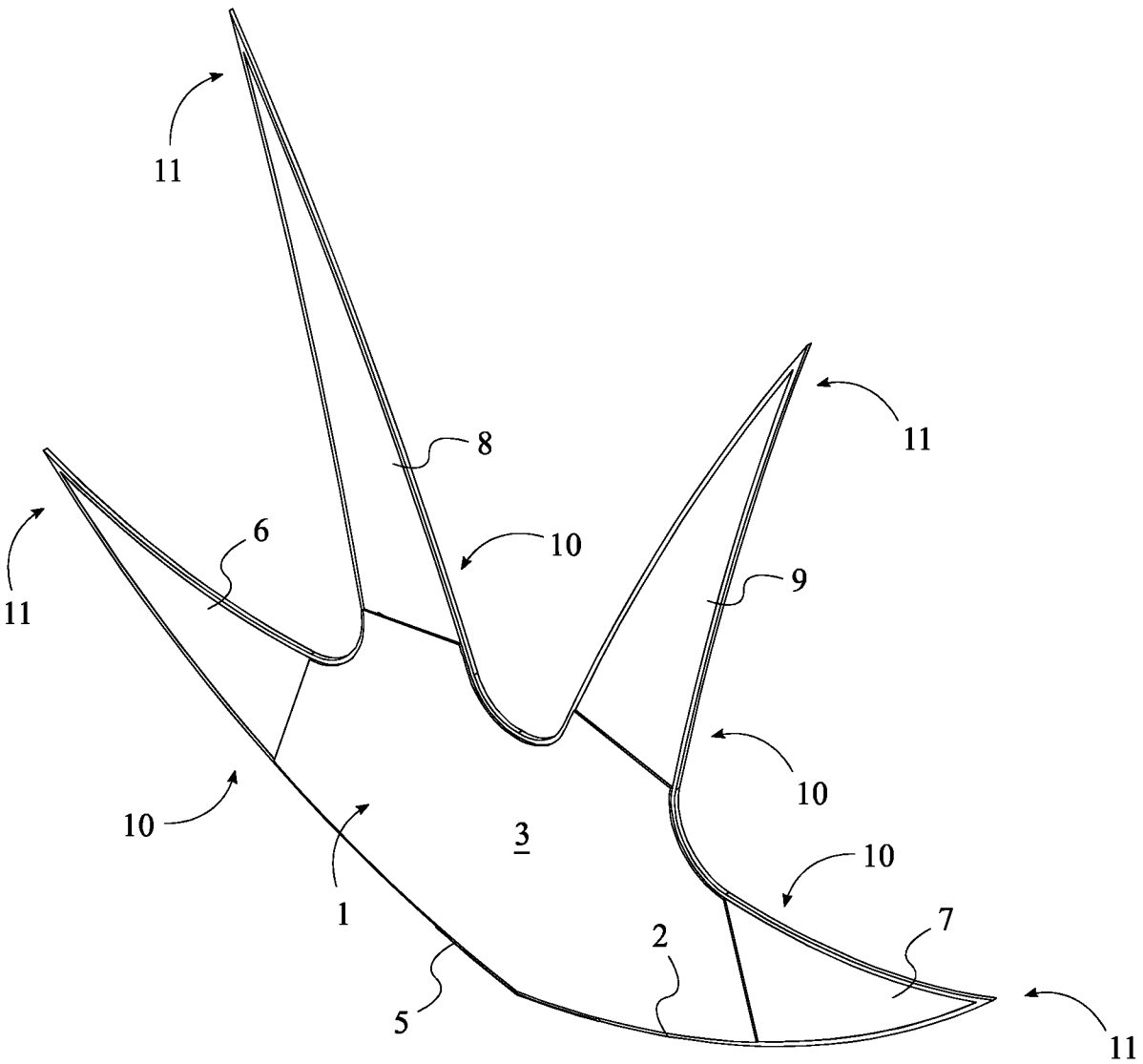
FIG. 1 is a front perspective view of the present invention.

The present invention is a head wrap that is used to fashionably cover the head and hair of a user. The present invention also allows the user to connect to various ornaments and decorations, as dictated by the current fashion trends of the time. The present invention comprises a head-bracing body 1, an elastic strip 5, a first lateral tail 6, a second lateral tail 7, a first intermediate tail 8, and a second intermediate tail 9, as seen in FIG. 1. The head-bracing body 1 acts as a hub to connect the first lateral tail 6, the second lateral tail 7, the first intermediate tail 8, and the second intermediate tail 9, allowing the user to grasp and tie the first lateral tail 6, the second lateral tail 7, the first intermediate tail 8, and the second intermediate tail 9 together.

Figure 2:
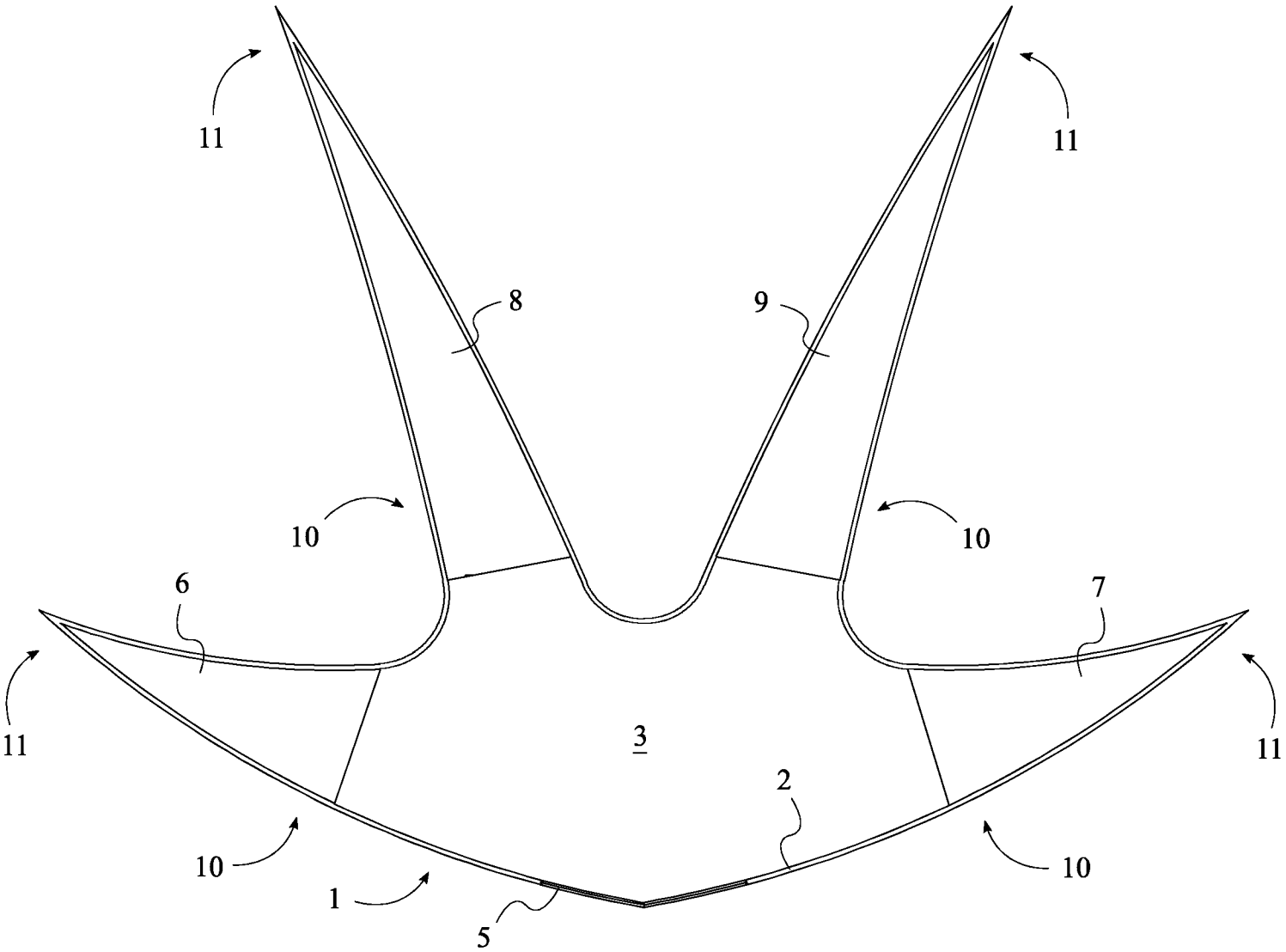
FIG. 2 is a front view of the present invention.

The general configuration of the aforementioned components allows the present invention to tie or wrap around a user's head for style and protection against heat. The head-bracing body 1 comprises a free edge 2. The free edge 2 enables appropriate tensioned engagement of the elastic strip 5 within the head-bracing body 1, as seen in FIG. 2. This arrangement allows the free edge 2 to stretch and conform against the user's head. The first lateral tail 6, the second lateral tail 7, the first intermediate tail 8, and the second intermediate tail 9 each comprise a proximal end 10 and a distal end 11. The proximal end 10 of the first lateral tail 6 connects adjacent to the head-bracing body 1. This allows the first lateral tail 6 to shift the head-bracing body 1 into position at the back of the user's head when the user tightens the first lateral tail 6 around the user's head. The proximal end 10 of the second lateral tail 7 connects adjacent to the head-bracing body 1, opposite the first lateral tail 6. This allows the second lateral tail 7 to shift the head-bracing body 1 into position at the back of the user's head when the user tightens the second lateral tail 7 around the user's head and provides a means for tightening the first lateral tail 6 to brace the head-bracing body 1 against the back of the user's head. The proximal end 10 of the first lateral tail 6 and the proximal end 10 of the second lateral tail 7 are positioned in between the first lateral tail 6 and the second lateral tail 7, about the head-bracing body 1. This arrangement allows the first lateral tail 6, the second lateral tail 7, the first intermediate tail 8, and the second intermediate tail 9 to span over a user's head. The proximal end 10 of the first lateral tail 6 and the proximal end 10 of the second lateral tail 7 are connected adjacent to the head-bracing body 1. This connection allows the user to brace the base layer 3 against the back of a user's head.

Moreover, the proximal end 10 of the first intermediate tail 8 is positioned offset from the proximal end 10 of the first lateral tail 6 about the head-bracing body 1, while the proximal end 10 of the second intermediate tail 9 is positioned offset from the proximal end 10 of the second lateral tail 7 about the head-bracing body 1. This allows for the first lateral tail 6 and the second lateral tail 7 to brace the sides of a user's head and allows the first intermediate tail 8 and the second intermediate tail 9 to brace the top of the user's head. The proximal end 10 of the first intermediate tail 8 is also positioned adjacent to the proximal end 10 of the second intermediate tail 9. This allows for improved coverage over the top of the user's head between the first intermediate tail 8 and the second intermediate tail 9, particularly close to the head-bracing body 1.

In order to cover the entirety of the user's head, the present invention requires the first intermediate tail 8, the second intermediate tail 9, the first lateral tail 6 and the second lateral tail 7 to taper in generally the same direction, thus allowing the present invention to cover the head area with minimal material overlap. The distal end 11 of the first intermediate tail 8 and the distal end 11 of the second intermediate tail 9 are oriented away from the free edge 2. This allows the first intermediate tail 8 and the second intermediate tail 9 to cover maximal head area on top of the user's head. The distal end 11 of the first lateral tail 6 and the distal end 11 of the second lateral tail 7 are also oriented away from the free edge 2. This allows the first lateral tail 6 and the second lateral tail 7 to cover maximal head area on the sides of the user's head.

The first lateral tail 6, second lateral tail 7, first intermediate tail 8, and the second intermediate tail 9 each taper from the proximal end 10 to the distal end 11. In this way, the distal end 11 of each of the first lateral tail 6, second lateral tail 7, first intermediate tail 8, and the second intermediate tail 9 may be tied together to hold the present invention in place.

Figure 3:
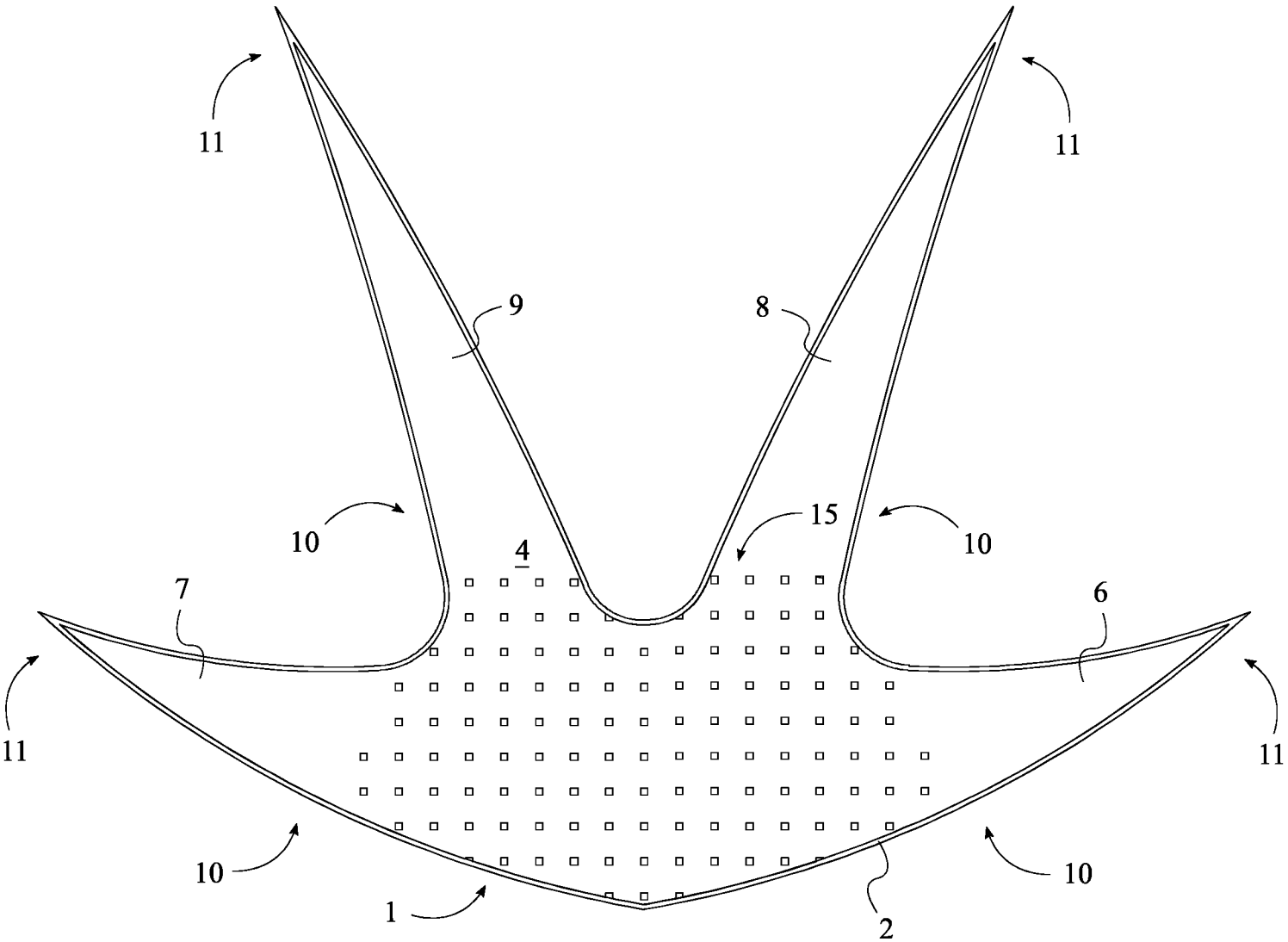
FIG. 3 is a back view of the present invention.
Figure 4:
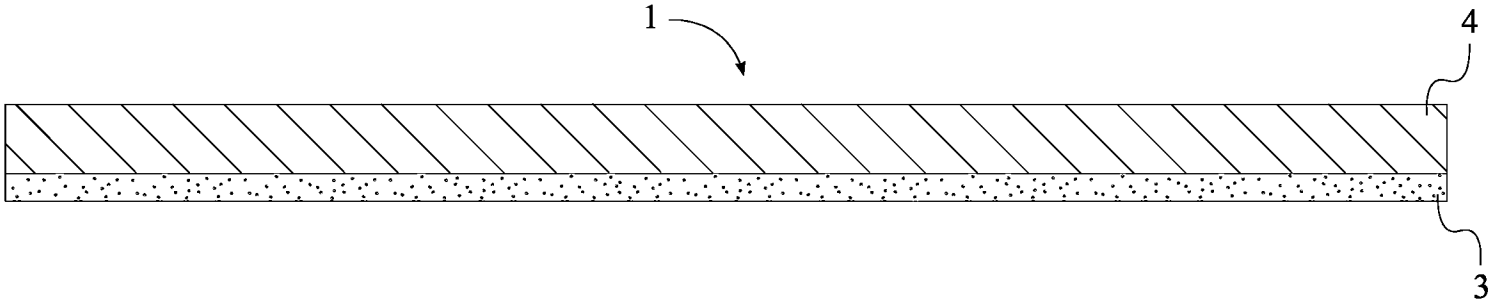
FIG. 4 is a schematic cross-sectional view of the head-bracing body for the present invention.

The head-bracing body 1 comprises an aesthetic layer 4 and a base layer 3. The aesthetic layer 4 is a fabric section that allows for the display of designs and patterns to increase the visual appeal of the head wrap, as seen in FIGS. 3 and 4. The aesthetic layer 4 is superimposed across the base layer 3 so that the base layer 3 is able to structurally support the aesthetic layer 4. In an exemplary embodiment, the base layer 3 is made of moisture-wicking fabric, or ventilating material; however, it is to be understood by a professional in the field of the invention that alternative embodiments using different materials are also possible and the exemplary embodiment is not meant to be limiting.

In another exemplary embodiment, the present invention further comprises a plurality of ventilation holes 15. The plurality of ventilation holes 15 is a linear pattern of preferably circular cuts traversing through the head-bracing body 1 that enables heat to dissipate through the present invention. The plurality of ventilation holes 15 is distributed across the head-bracing body 1, optimizing heat dissipation.

In some embodiments, the present invention further comprises at least one ornament 12. The at least one ornament 12 is a decorative unit which may be tied to the user's head. The at least one ornament 12 comprises a main decorative body 13 and a loop 14. The main decorative body 13 is laterally connected to the loop 14. This allows the distal end 11 of the first intermediate tail 8 and the distal end 11 of the second intermediate tail 9 to be tethered through the loop 14.

Figure 5:
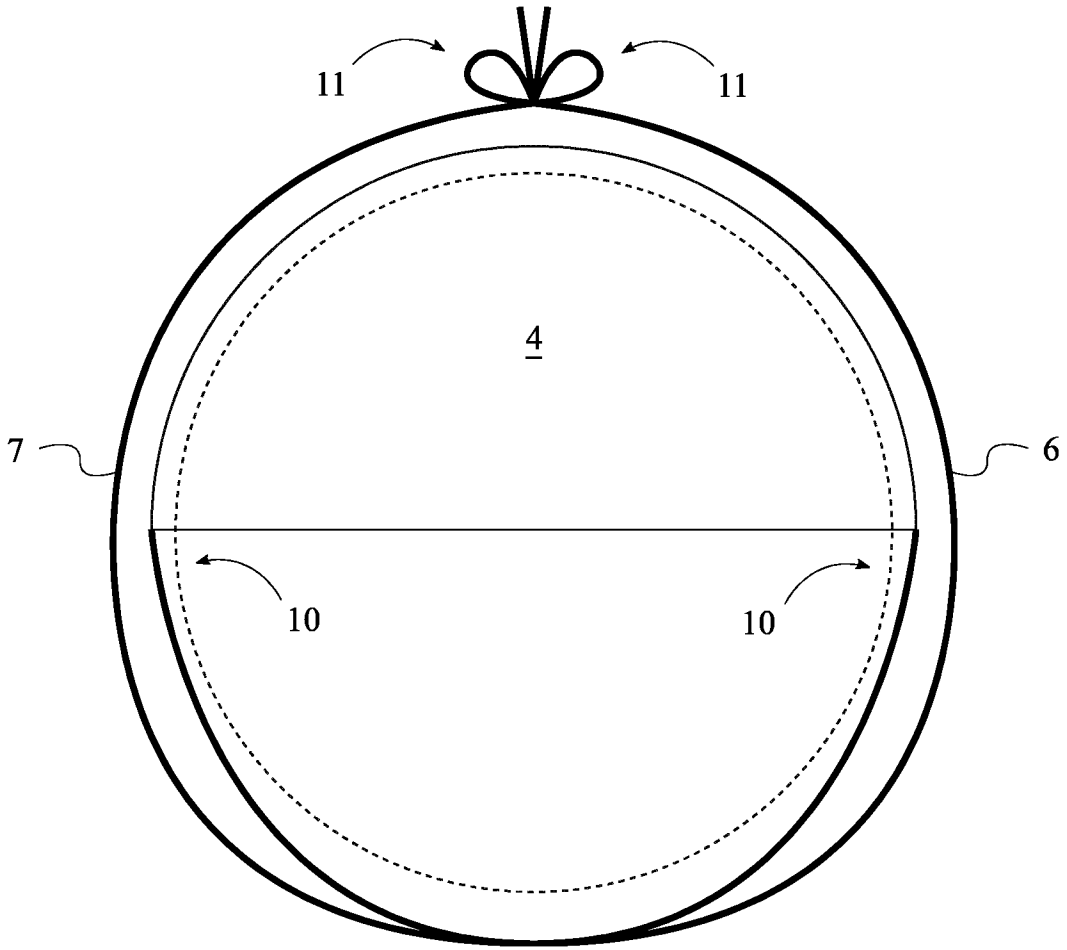
FIG. 5 is a top schematic view of the first lateral tail and the second lateral tail being wrapped and tied around the sides of the user's head.
Figure 6:
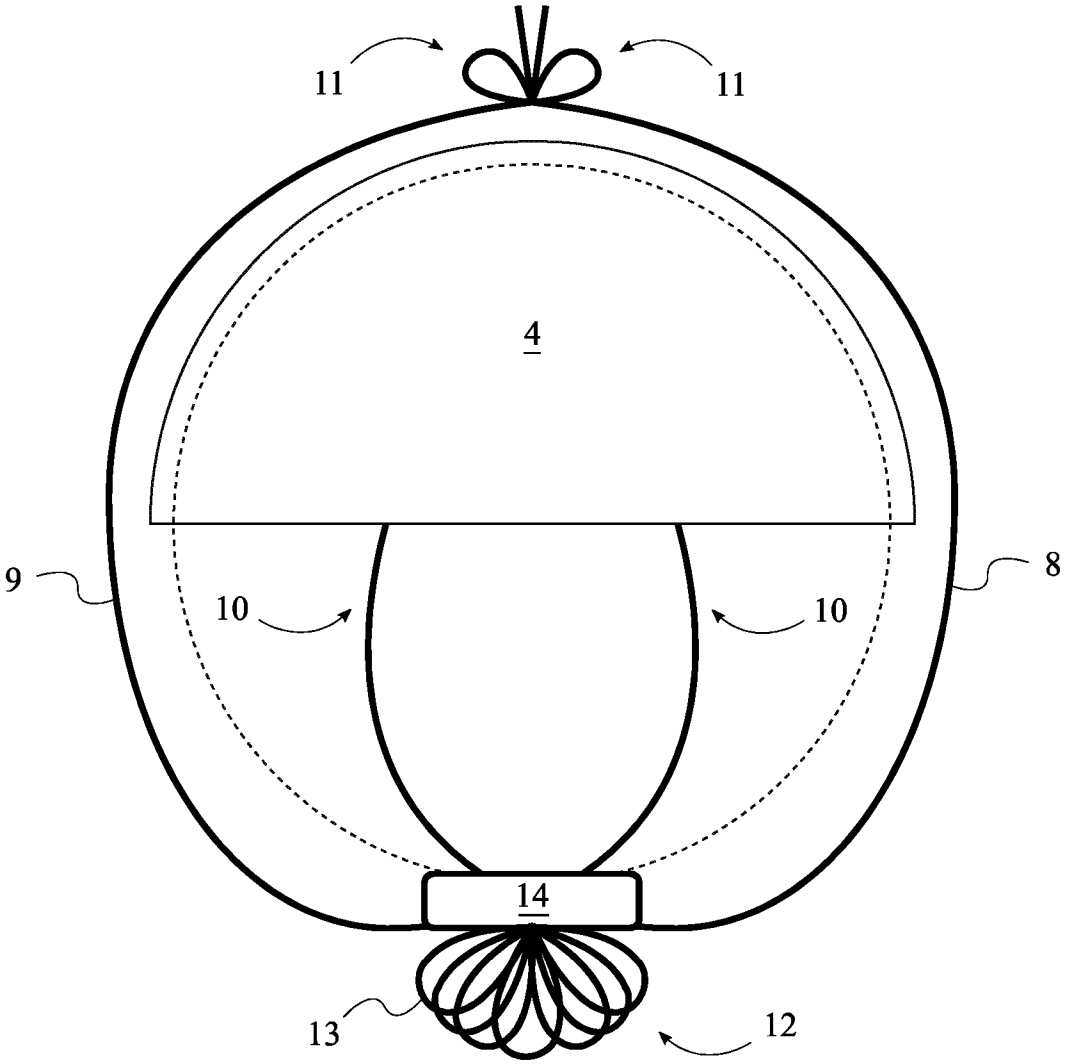
FIG. 6 is a top schematic view of the first intermediate tail and the second intermediate tail being wrapped about the top of the user's head and tied through the ornament.

In the preferred usage of the present invention, the user acquires the present invention and places the base layer 3 against the back of the user's head. The user grasps the first lateral tail 6 and the second lateral tail 7 and pulls the first lateral tail 6 and the second lateral tail 7 to the front of the user's head. The user then pulls the first lateral tail 6 and the second lateral tail 7 back across the user's head and ties the first lateral tail 6 and the second lateral tail 7 together, as seen in FIG. 5. The user then grasps the first intermediate tail 8 and the second intermediate tail 9. The user pulls the first intermediate tail 8 and the second intermediate tail 9 in opposite directions through the loop 14. The user then pulls the first intermediate tail 8 and the second intermediate tail 9 around the sides of the user's head and ties the distal end 11 of the first intermediate tail 8 and the distal end 11 of the second intermediate tail 9 together, as seen in FIG. 6.

Although the invention has been explained in relation to its preferred embodiment, it is to be understood that many other possible modifications and variations can be made without departing from the spirit and scope of the invention.

What is claimed is:

1. A head wrap comprises:
a head-bracing body;
an elastic strip;
a first lateral tail;
a second lateral tail;
a first intermediate tail;
a second intermediate tail;
the head-bracing body comprises a free edge;
the first lateral tail, the second lateral tail, the first intermediate tail, and the second intermediate tail each comprise a proximal end and a distal end;
the elastic strip being tensionably connected along the free edge;
the proximal end of the first lateral tail being connected adjacent to the head-bracing body;
the proximal end of the second lateral tail being connected adjacent to the head-bracing body, opposite the first lateral tail;
the proximal end of the first lateral tail and the proximal end of the second lateral tail being positioned in between the first lateral tail and the second lateral tail about the head-bracing body; and,
the proximal end of the first lateral tail and the proximal end of the second lateral tail being connected adjacent to the head-bracing body.

2. The head wrap as claimed in claim 1 comprises:
the proximal end of the first intermediate tail being positioned offset from the proximal end of the first lateral tail about the head-bracing body;
the proximal end of the first intermediate tail being positioned adjacent to the proximal end of the second intermediate tail; and,
the proximal end of the second intermediate tail being positioned offset from the proximal end of the second lateral tail about the head-bracing body.

3. The head wrap as claimed in claim 1 comprises:
the distal end of the first intermediate tail and the distal end of the second intermediate tail being oriented away from the free edge; and,
the distal end of the first lateral tail and the distal end of the second lateral tail being oriented away from the free edge.

4. The head wrap as claimed in claim 1 comprises:
the first lateral tail tapering from the proximal end to the distal end.

5. The head wrap as claimed in claim 1 comprises:
the second lateral tail tapering from the proximal end to the distal end.

6. The head wrap as claimed in claim 1 comprises:
the first intermediate tail tapering from the proximal end to the distal end.

7. The head wrap as claimed in claim 1 comprises:
the second intermediate tail tapering from the proximal end to the distal end.

8. The head wrap as claimed in claim 1 comprises:
the head-bracing body comprises an aesthetic layer and a base layer; and, the aesthetic layer being superimposed across the base layer.

9. The head wrap as claimed in claim 8, wherein the base layer is made of a moisture-wicking fabric.

10. The head wrap as claimed in claim 1 comprises:

a plurality of ventilation holes;

the plurality of ventilation holes traversing through the head-bracing body; and, the plurality of ventilation holes being distributed across the head-bracing body.

11. The head wrap as claimed in claim 1 comprises:

at least one ornament;

the least one ornament comprises a main decorative body and a loop;

the main decorative body being laterally connected to the loop; and, the distal end of the first intermediate tail and the distal end of the second intermediate tail being tethered through the loop.

12. A head wrap comprises:

a head-bracing body;

an elastic strip;

a first lateral tail;

a second lateral tail;

a first intermediate tail;

a second intermediate tail;

the head-bracing body comprises a free edge;

the first lateral tail, the second lateral tail, the first intermediate tail, and the second intermediate tail each comprise a proximal end and a distal end;

the elastic strip being tensionably connected along the free edge;

the proximal end of the first lateral tail being connected adjacent to the head-bracing body;

the proximal end of the second lateral tail being connected adjacent to the head-bracing body, opposite the first lateral tail;

the proximal end of the first lateral tail and the proximal end of the second lateral tail being positioned in between the first lateral tail and the second lateral tail about the head-bracing body;

the proximal end of the first lateral tail and the proximal end of the second lateral tail being connected adjacent to the head-bracing body;

the proximal end of the first intermediate tail being positioned offset from the proximal end of the first lateral tail about the head-bracing body;

the proximal end of the first intermediate tail being positioned adjacent to the proximal end of the second intermediate tail;

the proximal end of the second intermediate tail being positioned offset from the proximal end of the second lateral tail about the head-bracing body;

the distal end of the first intermediate tail and the distal end of the second intermediate tail being oriented away from the free edge; and, the distal end of the first lateral tail and the distal end of the second lateral tail being oriented away from the free edge.

13. The head wrap as claimed in claim 12 comprises:

the first lateral tail tapering from the proximal end to the distal end;

the second lateral tail tapering from the proximal end to the distal end;

the first intermediate tail tapering from the proximal end to the distal end; and, the second intermediate tail tapering from the proximal end to the distal end.

14. The head wrap as claimed in claim 12 comprises:

the head-bracing body comprises an aesthetic layer and a base layer;

the aesthetic layer being superimposed across the base layer; and, the base layer being made of a moisture-wicking fabric.

15. The head wrap as claimed in claim 12 comprises:

a plurality of ventilation holes;

the plurality of ventilation holes traversing through the head-bracing body; and, the plurality of ventilation holes being distributed across the head-bracing body.

16. The head wrap as claimed in claim 12 comprises:

at least one ornament;

the least one ornament comprises a main decorative body and a loop;

the main decorative body being laterally connected to the loop; and, the distal end of the first intermediate tail and the distal end of the second intermediate tail being tethered through the loop.

17. A head wrap comprises:

a head-bracing body;

an elastic strip;

a first lateral tail;

a second lateral tail;

a first intermediate tail;

a second intermediate tail;

the head-bracing body comprises a free edge;

the first lateral tail, the second lateral tail, the first intermediate tail, and the second intermediate tail each comprise a proximal end and a distal end;

the elastic strip being tensionably connected along the free edge;

the proximal end of the first lateral tail being connected adjacent to the head-bracing body;

the proximal end of the second lateral tail being connected adjacent to the head-bracing body, opposite the first lateral tail;

the proximal end of the first lateral tail and the proximal end of the second lateral tail being positioned in between the first lateral tail and the second lateral tail about the head-bracing body;

the proximal end of the first lateral tail and the proximal end of the second lateral tail being connected adjacent to the head-bracing body;

the proximal end of the first intermediate tail being positioned offset from the proximal end of the first lateral tail about the head-bracing body;

the proximal end of the first intermediate tail being positioned adjacent to the proximal end of the second intermediate tail;

the proximal end of the second intermediate tail being positioned offset from the proximal end of the second lateral tail about the head-bracing body;

the distal end of the first intermediate tail and the distal end of the second intermediate tail being oriented away from the free edge;

the distal end of the first lateral tail and the distal end of the second lateral tail being oriented away from the free edge;

the first lateral tail tapering from the proximal end to the distal end;

the second lateral tail tapering from the proximal end to the distal end;

the first intermediate tail tapering from the proximal end to the distal end; and, the second intermediate tail tapering from the proximal end to the distal end.

18. The head wrap as claimed in claim 17 comprises:

the head-bracing body comprises an aesthetic layer and a base layer;

the aesthetic layer being superimposed across the base layer; and, the base layer being made of a moisture-wicking fabric.

19. The head wrap as claimed in claim 17 comprises:

a plurality of ventilation holes;

the plurality of ventilation holes traversing through the head-bracing body;

and, the plurality of ventilation holes being distributed across the head-bracing body.

20. The head wrap as claimed in claim 17 comprises:

at least one ornament;

the least one ornament comprises a main decorative body and a loop;

the main decorative body being laterally connected to the loop; and, the distal end of the first intermediate tail and the distal end of the second intermediate tail being tethered through the loop.

* * * * *